US008894731B2

(12) United States Patent
Ramanath et al.

(10) Patent No.: US 8,894,731 B2
(45) Date of Patent: Nov. 25, 2014

(54) ABRASIVE PROCESSING OF HARD AND /OR BRITTLE MATERIALS

(75) Inventors: Srinivasan Ramanath, Holden, MA (US); Parul Walia, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1242 days.

(21) Appl. No.: 11/906,263

(22) Filed: Oct. 1, 2007

(65) Prior Publication Data

US 2009/0084042 A1 Apr. 2, 2009

(51) Int. Cl.
*B24B 1/00* (2006.01)
*B24D 3/00* (2006.01)

(52) U.S. Cl.
USPC ..... 51/296

(58) Field of Classification Search
CPC ..... B24D 5/00; B24D 7/00; B24D 3/00; B24B 1/00
USPC ..... 51/296
See application file for complete search history.

(56) References Cited

U.S. PATENT DOCUMENTS

| | | | |
|---|---|---|---|
| 2,828,197 | A | 3/1958 | Blackmer, Jr. |
| 2,831,243 | A | 4/1958 | Thomson |
| 2,849,789 | A | 9/1958 | Thomson |
| 3,352,647 | A | 11/1967 | MacDonald et al. |
| 3,352,668 | A | 11/1967 | MacDonald et al. |
| 3,372,010 | A | 3/1968 | Parsons |
| 3,886,925 | A | 6/1975 | Regan |
| 3,973,925 | A | 8/1976 | Asaeda et al. |
| 4,010,583 | A | 3/1977 | Highberg |
| 4,173,685 | A | 11/1979 | Weatherly |

(Continued)

FOREIGN PATENT DOCUMENTS

| | | | |
|---|---|---|---|
| JP | 63297489 | 12/1988 | ..... B24D 3/00 |
| JP | 1064779 | 3/1989 | ..... B24D 3/00 |

(Continued)

OTHER PUBLICATIONS

International Search Report dated Mar. 3, 2009, from corresponding International Application No. PCT/US2008/078071, filed on Sep. 29, 2008.

(Continued)

*Primary Examiner* — Melvin C Mayes
*Assistant Examiner* — Michael Forrest
(74) *Attorney, Agent, or Firm* — Joseph P. Sullivan; Abel Law Group, LLP

(57) ABSTRACT

Abrasive articles possessing a highly open (porous) structure and uniform abrasive grit distribution are disclosed. The abrasive articles are fabricated using a metal matrix (e.g., fine nickel, tin, bronze and abrasives). The open structure is controlled with a porosity scheme, including interconnected porosity (e.g., formed by leaching of dispersoid), closed porosity (e.g., induced by adding a hollow micro-spheres and/or sacrificial pore-forming additives), and/or intrinsic porosity (e.g., controlled via matrix component selection to provide desired densification). In some cases, manufacturing process temperatures for achieving near full density of metal bond with fillers and abrasives, are below the melting point of the filler used, although sacrificial fillers may be used as well. The resulting abrasive articles are useful in high performance cutting and grinding operations, such as back-grinding silicon, alumina titanium carbide, and silicon carbide wafers to very fine surface finish values. Techniques of use and manufacture are also disclosed.

16 Claims, 7 Drawing Sheets

(56) References Cited

U.S. PATENT DOCUMENTS

| | | | | | |
|---|---|---|---|---|---|
| 4,180,048 | A | | 12/1979 | Regan | |
| 4,738,689 | A | | 4/1988 | Gigl et al. | |
| 4,977,710 | A | | 12/1990 | Une | |
| 5,203,886 | A | * | 4/1993 | Sheldon et al. | 51/309 |
| 5,213,589 | A | | 5/1993 | Ronning et al. | |
| 5,221,294 | A | | 6/1993 | Carman et al. | |
| 5,429,648 | A | | 7/1995 | Wu | |
| 5,500,450 | A | | 3/1996 | Simandl et al. | |
| 5,607,346 | A | | 3/1997 | Wilson et al. | |
| 5,718,736 | A | * | 2/1998 | Onishi et al. | 51/307 |
| 5,738,696 | A | | 4/1998 | Wu | |
| 5,738,697 | A | | 4/1998 | Wu et al. | |
| 5,832,360 | A | | 11/1998 | Andrews et al. | |
| 5,940,507 | A | | 8/1999 | Ramanath et al. | |
| 5,951,378 | A | | 9/1999 | Miller et al. | |
| 6,019,667 | A | | 2/2000 | Bush et al. | |
| 6,019,668 | A | | 2/2000 | Ramanath et al. | |
| 6,056,795 | A | | 5/2000 | Ramanath et al. | |
| 6,063,148 | A | * | 5/2000 | Fischbacher | 51/293 |
| 6,086,648 | A | | 7/2000 | Rossetti, Jr. et al. | |
| 6,093,092 | A | | 7/2000 | Ramanath et al. | |
| 6,101,507 | A | | 8/2000 | Ramanath et al. | |
| 6,102,789 | A | | 8/2000 | Ramanath et al. | |
| 6,157,931 | A | | 12/2000 | Cane et al. | |
| 6,193,593 | B1 | | 2/2001 | Miller et al. | |
| 6,200,208 | B1 | | 3/2001 | Andrews et al. | |
| 6,224,473 | B1 | | 5/2001 | Miller et al. | |
| 6,254,660 | B1 | | 7/2001 | Bernard et al. | |
| 6,319,108 | B1 | | 11/2001 | Adefris et al. | |
| 6,354,929 | B1 | | 3/2002 | Adefris et al. | |
| 6,372,012 | B1 | | 4/2002 | Majagi et al. | |
| 6,416,560 | B1 | * | 7/2002 | Palmgren | 51/309 |
| 6,478,831 | B2 | | 11/2002 | Tselesin | |
| 6,536,352 | B1 | | 3/2003 | Nadkarni et al. | |
| 6,593,391 | B2 | | 7/2003 | Teutsch et al. | |
| 6,679,758 | B2 | | 1/2004 | Bright et al. | |
| 6,685,755 | B2 | * | 2/2004 | Ramanath et al. | 51/296 |
| 6,713,873 | B1 | | 3/2004 | O'Loughlin et al. | |
| 6,755,729 | B2 | | 6/2004 | Ramanath et al. | |
| 6,770,107 | B2 | | 8/2004 | Teutsch et al. | |
| 7,077,723 | B2 | | 7/2006 | Bright et al. | |
| 7,275,980 | B2 | | 10/2007 | Bonner et al. | |
| 8,197,303 | B2 | | 6/2012 | Tanikella et al. | |
| 2001/0025457 | A1 | | 10/2001 | Tselesin | |
| 2002/0069592 | A1 | | 6/2002 | Sherman et al. | |
| 2003/0018116 | A1 | | 1/2003 | Teutsch et al. | |
| 2003/0153641 | A1 | | 8/2003 | Guo et al. | |
| 2004/0033772 | A1 | * | 2/2004 | Goers | 451/526 |
| 2005/0108948 | A1 | | 5/2005 | Sung | |
| 2005/0260939 | A1 | | 11/2005 | Andrews et al. | |
| 2006/0059785 | A1 | | 3/2006 | Sung | |
| 2006/0213128 | A1 | | 9/2006 | Sung | |
| 2007/0164490 | A1 | | 7/2007 | Cooper et al. | |
| 2008/0168718 | A1 | | 7/2008 | Egan et al. | |
| 2009/0084042 | A1 | | 4/2009 | Ramanath et al. | |

FOREIGN PATENT DOCUMENTS

| | | | | | |
|---|---|---|---|---|---|
| JP | 91-161273 | | | 7/1991 | B24D 3/18 |
| JP | 91-281174 | | | 12/1991 | B24D 3/18 |
| JP | 9103965 | A | | 4/1997 | |
| JP | 10-230464 | | | 9/1998 | |
| JP | 2000233374 | A | * | 8/2000 | B24D 3/06 |
| JP | 2001-246566 | | | 9/2001 | |
| JP | 2002001668 | | | 8/2002 | |
| JP | 2004-148469 | | | 5/2004 | B24D 3/06 |
| JP | 2004148469 | A | | 5/2004 | |
| JP | 2004-291218 | A | | 10/2004 | |
| JP | 2005136227 | | | 5/2005 | B24B 7/20 |
| JP | 2005525242 | A | | 8/2005 | |
| JP | 2005254352 | | | 9/2005 | B24D 3/10 |
| JP | 2006346857 | A | | 12/2006 | |
| UA | 9549 | U | | 10/2005 | |
| WO | 99/48646 | A1 | | 9/1999 | |

OTHER PUBLICATIONS

International Preliminary Report on Patentability dated Apr. 7, 2010, from corresponding International Application No. PCT/US2008/078071, filed on Sep. 29, 2008.

U.S. Appl. No. 60/882,343, filed Dec. 28, 2006.

U.S. Appl. No. 11/963,454, filed Dec. 21, 2007.

International Search Report from PCT/US2009/049158 mailed Feb. 17, 2010, 1 page.

* cited by examiner

Wheel Speed = 3000 rpm
Work Speed = 590 rpm
Down Feed = 0.05 μm/sec
Total Stock = 20 μm
Wheel diameter = 282 mm

ABRASIVE PROCESSING OF HARD AND /OR BRITTLE MATERIALS

FIELD OF THE INVENTION

The invention relates to abrasives technology, and more particularly, to abrasive tools and techniques for processing hard and/or brittle materials, such as semiconductor wafers used in the electronics industry.

BACKGROUND OF THE INVENTION

The use of porous abrasives tools to improve mechanical grinding processes is generally well known. Pores of an abrasive tool typically provide access to grinding fluids, such as coolants and lubricants, which tend to promote more efficient cutting, minimize metallurgical damage (e.g., surface burn), and maximize tool life. Pores also permit the clearance of material (e.g., chips or swarf) removed from the workpiece being ground, which is important especially when the workpiece being ground is relatively soft or when surface finish requirements are demanding (e.g., such as the case when back-grinding silicon carbide wafers).

Techniques for fabricating abrasive tools having porosity may generally be classified into one of two categories. In the first category, a pore structure is created by the addition of organic pore inducing media, such as ground walnut shells or plastic beads of the appropriate dimensions, into the abrasive article. These media are sacrificial, in that they thermally decompose upon firing, leaving voids or 'pores' in the cured abrasive tool. Examples of this category are discussed in U.S. Pat. Nos. 5,221,294 and 5,429,648. In the second category, a pore structure may be created by the addition of closed cell materials, such as bubble alumina, into an abrasive article. Unlike sacrificial media, this type of media survives the firing process, and remains in the cured abrasive tool to form pores. Examples of this category are discussed, for example, U.S. Pat. No. 5,203,886. Each of U.S. Pat. Nos. 5,221,294, 5,429,648, and 5,203,886 is herein incorporated by reference in its entirety.

In an alternative approach, porosity can be achieved within an abrasive article through the use of fiber-like abrasive grains having a length to diameter aspect ratio of, for example, 5:1 or greater. Examples of this approach are discussed in U.S. Pat. Nos. 5,738,696 and 5,738,697, each of which is herein incorporated by reference in its entirety. The poor packing characteristics of the elongated abrasive grains result in an abrasive article including increased porosity and permeability and suitable for relatively high-performance grinding. In another alternative approach, porosity can be created within an abrasive article by the leaching of a filler, such as common salt. Examples of this approach are discussed in U.S. Pat. Nos. 6,685,755 and 6,755,729, each of which is herein incorporated by reference in its entirety.

As market demand has grown for precision components in products such as engines, refractory equipment, and electronic devices (e.g., silicon and silicon carbide wafers, magnetic heads, and display windows), the need has grown for improved abrasive tools for fine precision grinding and polishing of ceramics and other relatively hard and/or brittle materials. Therefore, there exists a need for improved abrasive articles and abrasive tools, and in particular, those including a relatively high degree of porosity.

SUMMARY OF THE INVENTION

One embodiment of the present invention provides a composite that can be used for abrasive processing a workpiece (e.g., such as silicon carbide wafers, sapphire, or other such hard materials) to a desired surface finish. The composite includes a plurality of abrasive grains and a metal bond thermally processed together with the abrasive grains to form a composite. The metal bond includes at least one starting powder component having an average particle size that is at most 15 times larger than the average particle of the abrasive grains. In other configurations, the at least one starting powder component in the metal bond has an average particle size that is smaller (e.g., where ratio of starting powder size to abrasive size ranges from 10:1 to 2:1, or even less such as the case where the starting powder size is less than the abrasive size). The composite has from about 0.25 to 40 volume percent abrasive grain, from about 10 to 60 percent metal bond, and from about 40 to 90 volume percent total porosity. The total porosity includes intrinsic pores, closed pores, and interconnected pores. The desired surface finish of the workpiece is 500 Angstroms or less, Ra (e.g., 30 Angstroms or less, Ra for a silicon carbide workpiece, or 200 Angstroms or less, Ra for a sapphire workpiece). The metal bond may include, for example, one or more of nickel, cobalt, silver, iron, tin, zinc, tungsten, molybdenum, aluminum, copper, and titanium. The metal bond may further include one or more of boron, silicon, phosphorous, graphite, hexagonal boron-nitride, molybdenum disulfide, tungsten disulfide, and alumina. In one particular embodiment, the metal bond is a nickel-tin-bronze system that includes from about 25 to 60 weight percent nickel, from about 20 to 60 weight percent tin, and from about 20 to 60 weight percent bronze. In one such case, the bronze has a copper-tin ratio from about 95:5 to 40:60 by weight percent. The composite may form, for example, at least part of an abrasive rim that is operatively coupled to a core (e.g., via a thermally stable bond). In one particular such case, the core has a circular perimeter and a minimum specific strength of 2.4 MPa-$cm^3$/g and a core density of 0.5 to 8.0 g/$cm^3$.

Another embodiment of the present invention provides a method for abrasive processing a hard material workpiece to a desired surface finish. The method includes mounting workpiece onto a machine capable of facilitating abrasive processing (e.g., a wafer back-grinding machine), and operatively coupling an abrasive tool to the machine. The tool includes a composite having a metal bond thermally processed together with a plurality of abrasive grains having an average particle size in the range of 0.01 to 100 microns. The metal bond includes at least one starting powder component having an average particle size that is at most 15 times larger than the average particle of the abrasive grains. The composite includes from about 0.25 to 40 volume percent abrasive grain, from about 10 to 60 percent metal bond, and from about 40 to 90 volume percent total porosity. The total porosity includes intrinsic pores, closed pores, and interconnected pores. The method continues with contacting the abrasive tool to a surface of the workpiece until the desired surface finish of the workpiece is achieved, wherein the desired surface finish is 500 Angstroms or less, Ra. Note that contacting the abrasive tool to a surface of the workpiece may include moving the abrasive tool toward the workpiece and/or moving the workpiece toward the abrasive. In one particular case, the workpiece comprises a semiconductor wafer (e.g., silicon carbide) and abrasive processing includes polishing and/or back-grinding the wafer. In another particular case, the workpiece is a single crystal silicon carbide wafer and the desired surface finish is in the range of 15 to 25 Angstroms, $R_a$.

Another embodiment of the present invention provides a method for manufacturing a composite that can be used for abrasive processing a workpiece to a desired surface finish. The method includes providing a plurality of abrasive grains, and thermally processing a metal bond together with the abrasive grains to form a composite. The metal bond includes at least one starting powder component having an average particle size that is at most 15 times larger than the average particle of the abrasive grains. The composite has from about 0.25 to 40 volume percent abrasive grain, from about 10 to 60 percent metal bond, and from about 40 to 90 volume percent total porosity. The total porosity includes intrinsic pores, closed pores, and interconnected pores. The grains have an average particle size in the range of 0.01 to 100 microns. In one particular case, the metal bond is a nickel-tin-bronze system that includes from about 25 to 60 weight percent nickel, from about 20 to 60 weight percent tin, and from about 20 to 60 weight percent bronze, wherein the bronze has a copper-tin ratio from about 95:5 to 40:60 by weight percent. In one such case, the method includes blending nickel powder with a plurality of abrasives to form a mix, blending tin powder into the mix; and blending bronze powder into the mix that includes the tin powder. Blending the bronze powder into the mix may further include at least one of the following: blending hollow glass spheres into the mix, blending sacrificial pore-inducer material into the mix, and blending a dispersoid into the mix. In one such case, the dispersoid includes a plurality of cubic shaped particles (although other shapes whether regular or irregular can be used as well). In another such case, thermally processing a metal bond together with the abrasive grains includes thermally processing (e.g., sintering, hot-pressing, and hot-coining) the mix to form an abrasive article. Other suitable forming processes will be apparent in light of this disclosure (e.g., such as tape-casting to form green tape abrasive article and then sintering of green tape article, or injection molding a green article and then sintering of the green article). After thermal processing, the method may include immersing the abrasive article in a solvent to leach out the dispersoid, thereby leaving interconnected pores within the abrasive article. The interconnected pores may be induced, for example, with a dispersoid that has a melting point, where the composite is thermally processed at a temperature below the melting point of the dispersoid. The closed pores may be induced, for example, with a hollow filler that has a softening point and a melting point, where the composite is thermally processed at a temperature below at least one of the softening point or melting point of the hollow filler. The closed pores may be induced, for example, with a pore-forming additive that has a degradation temperature, where the composite is thermally processed at a temperature above the degradation temperature of the pore-forming additive. The method may include operatively coupling (e.g., via a thermally stable bond) the composite to a core so as to form at least part of an abrasive rim of a tool. In one particular such case, the core has a circular perimeter and, for example, a minimum specific strength of 2.4 MPa-cm$^3$/g and a core density of 0.5 to 8.0 g/cm$^3$.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1A:
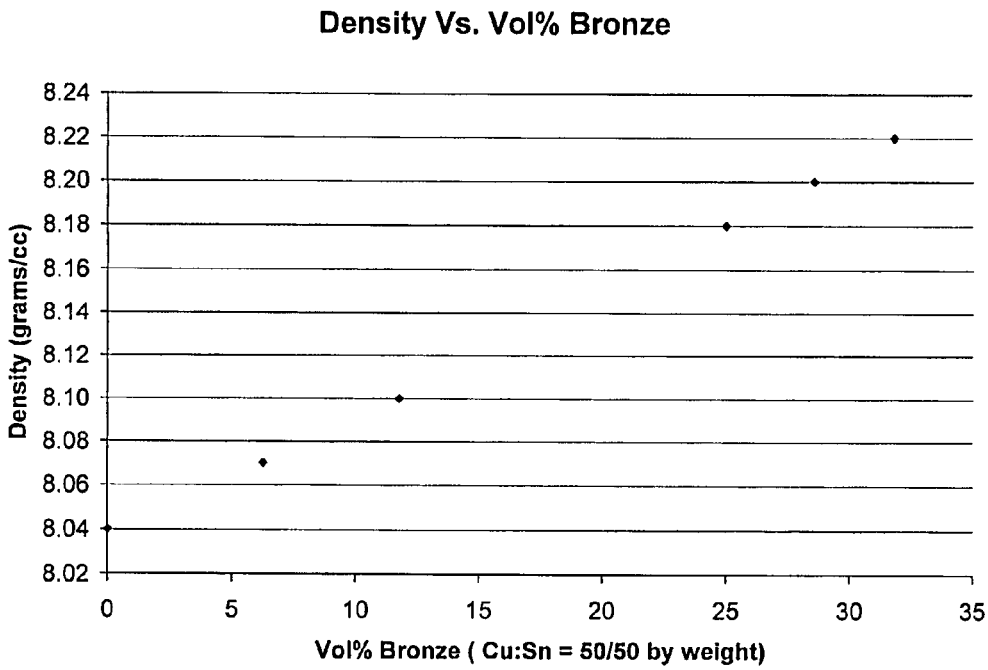
FIGS. 1*a-c* each illustrate various relationships between the amount of bronze in a metal bond and characteristics of the bond, including density, porosity, and hardness, in accordance with one embodiment of the present invention.

Techniques are disclosed for producing abrasive articles possessing a highly open structure (e.g., 40% to 80% porosity) and uniform abrasive grit distribution. In some such embodiments, the abrasive articles are fabricated using a metal matrix comprising fine nickel, tin, bronze and abrasives, and possess excellent oxidation resistance during processing. The resulting abrasive articles are useful in high performance grinding operations, such as back-grinding silicon, alumina titanium carbide, and silicon carbide wafers (typically used in the manufacture of electronic components) to very fine surface finish values. In a more general sense, the resulting abrasive articles can remove stock and produce mirror finishes on materials possessing hardness values (e.g., ranging from about 500 HV to 3200 HV). Fracture toughness of such work-materials typically ranges from about 0.6 to 20 MPa.m$^{1/2}$. Example work materials that can be ground or otherwise abrasively processed to suitable surface finish using embodiments of the present invention include oxides, carbides, silicides, borides, nitrides, oxy-nitrides, etc (e.g., such as silicon carbide, titanium diboride, boron carbide, sapphire, glass, quartz, gallium arsenide, gallium, nitride, and elemental silicon). Note that the achievable surface finish will depend on the work material.

General Overview

As previously explained, abrasive structures possessing a highly open structure can be created using a number of techniques, including leaching of filler such as common salt (see previously incorporated U.S. Pat. No. 6,755,729). Such structures may include, for example, a copper-tin based bond system with abrasives grits of desired size embedded within the bond. Use of a copper-tin bond system enables processing of such structures at temperatures well below the melting point of the filler. For instance, a copper-tin based bond system at a lower temperature than the melting point of common salt. The typical size of copper powder used is about 44 microns (−325 mesh). Such a size permits low oxidation of copper and enables a relatively good grit distribution.

However, to produce ultra-fine surface finishes, the average size of the abrasive grit is reduced to below 10 microns. As the abrasive particles are reduced to such fine sizes, they tend to agglomerate more readily when used with coarse 44 micron copper. This results in poor grit distribution and the inability to produce ultra-fine surfaces on the work piece.

One way to improve the abrasive grit distribution is to lower the size of copper powder used. As the copper size is reduced, however, its ratio of surface area to volume increases, leading to rapid oxidation. Such oxidation subsequently leads to formation of an oxide layer on the surface of each copper particle and its poor sinterability with tin. The grit retention ability of such a bond also drops considerably, leading to a low quality and inconsistent product. One way to reduce this is to select metals and alloys that have reduced tendencies to oxidize even in fine sizes.

For example, substitution of fine nickel (e.g., under 5 microns) in place of copper will maintain a low level of oxidation and excellent sinterability to tin. While nickel by itself requires a process temperature of over 1000° C., the addition of tin lowers that process temperature to below 1000° C. and also embrittles the bond for use in grinding wheels. Further reduction of process temperature may be needed, if a dispersoid having a relatively low melting point, such as sodium chloride (common salt, which has a melting point of about 800° C.), is used to create the open structures. This reduction of process temperature can be accomplished, and in accordance with one embodiment of the present invention, through the addition of a material such as bronze (e.g., 50/50 by weight copper-tin alloy). Near full-density can be achieved by hot-pressing (or other suitable processing) a composite consisting of 35/35/30 by weight of fine nickel, tin, and 50/50 bronze alloy, at temperatures as low as 750° C.

In accordance with one such embodiment of the present invention, making such a nickel-tin-bronze bond involves first forming the bronze alloy (e.g., by combining copper and tin), and secondly mixing a powder of the bronze with appropriate amounts of nickel and tin. Note that a commercially available bronze alloy can be used here. An elemental composition (i.e., mixing all components as elemental powders at once) that includes the same percentages of nickel, tin, and copper yields different performance qualities and may not be suitable for all applications. For instance, an elemental composition yields a metal bond that is harder than a nickel, tin, and bronze alloy composition. In abrasive applications, and as will be discussed in turn, the hardness of the bond, in conjunction with porosity of the bond (intrinsic, closed, and/or interconnected porosities), directly impacts how the resulting abrasive tool breaks down during use and the tool's ability to self-dress, as well as the quality of the resulting surface finish on the workpiece. Finding the appropriate balance of such variables for a given application is generally a non-trivial undertaking. In a wafer grinding or polishing application (such as back-grinding silicon carbide wafers), the excessive hardness associated with an elemental composition may provide less than desired results. In such cases, a nickel, tin, and bronze alloy composition can be effectively used.

In one example abrasive application, when such a nickel, tin, and bronze alloy composition is mixed with abrasive grits as fine as 1 to 2 microns (or even finer) and an adequate amount of salt (e.g., over 50% by volume). The mixture is hot-pressed to densify the abrasive structure. Leaching of the salt from the fired structure provides an abrasive article that possesses controlled interconnected porosity and is well-suited for grinding materials such as semiconductor wafers. Additional closed porosity can be attained in the abrasive structure by introducing hollow micro-spheres, such as glass or ceramic or metal spheres. Sacrificial pore inducers that burn out of the tool during processing can also be used, such as crushed walnut shells or plastic beads.

Alternatively, the same composite of fine nickel and tin (50/50), without the bronze alloy, provides a more intrinsically porous structure (e.g., up to about 22% porous), without the addition of any salt or other dispersoid pore inducer. It will be appreciated in light of this disclosure that, at given process parameters (particularly temperature and pressure), the bronze alloy content can be increased or otherwise manipulated to control this intrinsic porosity (i.e., the more bronze alloy in the nickel-tin bond system, the less intrinsic porosity; the less bronze alloy in the nickel-tin bond system, the more intrinsic porosity).

Thus, porosity in the resulting abrasive article can be intrinsic porosity (e.g., controlled based on the components/composition selected for the bond systems and process parameters such as temperature and pressure), closed porosity (e.g., controlled through the use of persistent pore inducers that survive the firing process and/or sacrificial pore inducers), and/or interconnected porosity (e.g., controlled through the use of leachable dispersoids such as salt). Note that the intrinsic porosity is not merely fortuitous or a function of happenstance, but is effectively provided in a controlled fashion, based on the chosen bond composition and process parameters. Combinations of intrinsic, closed, and interconnected porosities can be fine tuned to satisfy the performance criteria of a given application.

Further note that other materials can take the place of nickel and/or tin such as, for example, cobalt, silver, iron, tin, zinc, tungsten, molybdenum, aluminum, copper, and titanium; and sometimes with small additions of boron, silicon and/or phosphorous. In any case, the resulting abrasive composites can be, for instance, hot-pressed, sintered, hot-coined, or otherwise processed with suitable powder metallurgy processes to form abrasive articles sized and shaped for various applications, including processing of semiconductor materials.

Abrasive Article Structure and Composition

An abrasive article configured in accordance with an embodiment of the present invention can take any number of forms, depending on factors such as the application at hand and desired product cost. Various embodiments described herein are suitable for use in, for example, abrasive processing of hard and or brittle materials, and in particular, for operations such as back-grinding silicon, alumina titanium carbide, and silicon carbide semiconductor wafers. Another example application could be abrasive hone tools which can be used for grinding and polishing of hard and/or brittle materials. Other such applications will be apparent in light of this disclosure.

In one particular embodiment, an abrasive article for a grinding wheel is provided, wherein the article can be a segment or other discrete section of an overall wheel. Alternatively, the abrasive article can be a monolithic wheel design. The abrasive article includes a composite including a plurality of abrasive grains and a metal bond matrix sintered together (other suitable powder metallurgy processes, such as hot-pressing, hot-coining, and injection molding can also be used if so desired). In addition, the composite includes a combination of intrinsic, closed, and interconnected pores disposed therein. In this example embodiment, the composite includes from about 0.25 to 40 volume percent abrasive grain, from about 10 to 60 volume percent metal bond, and from about 40 to 90 volume percent total porosity (which may include intrinsic, closed, and/or interconnected pores).

The abrasive grains can be, for example, superabrasive grains such as diamond and/or cubic boron nitride. Alternatively, or in addition to, the abrasive grains can be, for example, alumina, silicon-carbide, boron-carbide, and/or zirconia (other suitable abrasive grains will be apparent in light of this disclosure). The size of the grains will depend on the particular application and its various performance criteria (e.g., desired removal rates and surface finish), but in one particular embodiment, the abrasive grains have an average particle size in the range of 0.01 to 300 microns. In other embodiments, the average particle size is 100 microns or less. In other embodiments, the average particle size is 5 microns or less.

The volume of the respective pore types can vary, as will be appreciated in light of this disclosure. In one embodiment, the volume of interconnected pores is in the range of 50 to 80%, the volume of closed pores is in the range of 0.01 to 90%, and the volume of intrinsic pores is in the range of 0.01 to 20%. The size of the pores may vary as well. For example, and in accordance with one embodiment, the average size of interconnected pores is in the range of 40 to 400 microns, the average size of closed pores is in the range of 5 to 400 microns, and the average size of intrinsic pores is below 40 microns. In one particular case, the pore size distribution is 7:1 for higher packing efficiency required for porosity of greater than 64%. For instance, assume spherical salt particles of one size are used in a bond. From geometry, the best packing density achievable which such spheres is 64% by volume. The remainder volume is occupied by open space. If the space between the salt particles is filled with metal bond and diamond, the maximum porosity level achievable after the salt is leached out is 64%. In order to increase this porosity level, the space between the salt particles can be filled with smaller size salt particles. The largest size (diameter) of salt particle that can fit in this space is ⅐th the diameter of the original salt particles. This type of packing may continue with smaller and smaller salt particles to thereby increase the packing efficiency (or in this example case, pores after leaching) to a high value. Note, however, that the inherent strength of the resulting structure must be suitable for the given application.

Figure 1B:
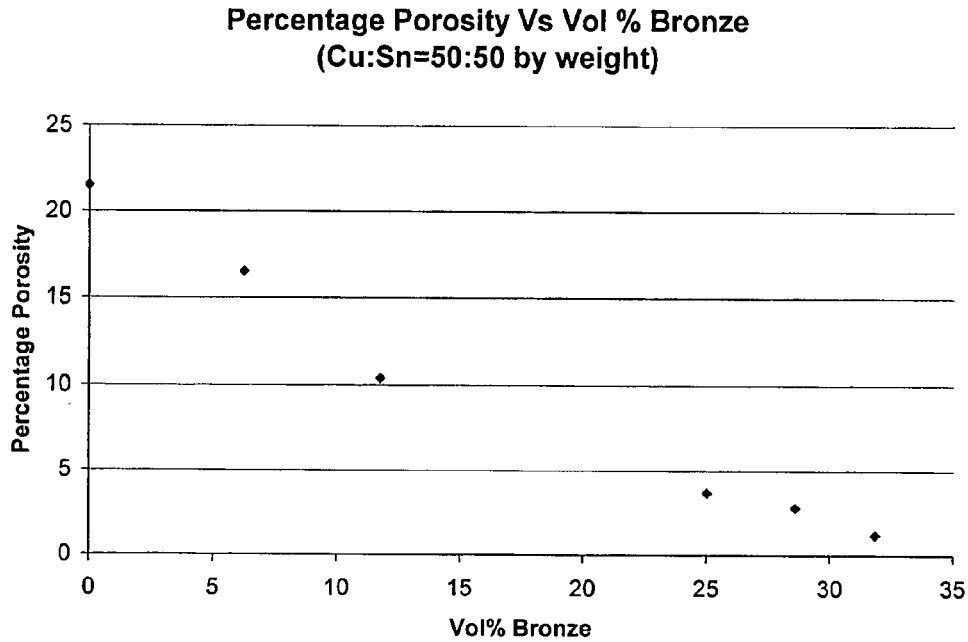
Figure 1C:
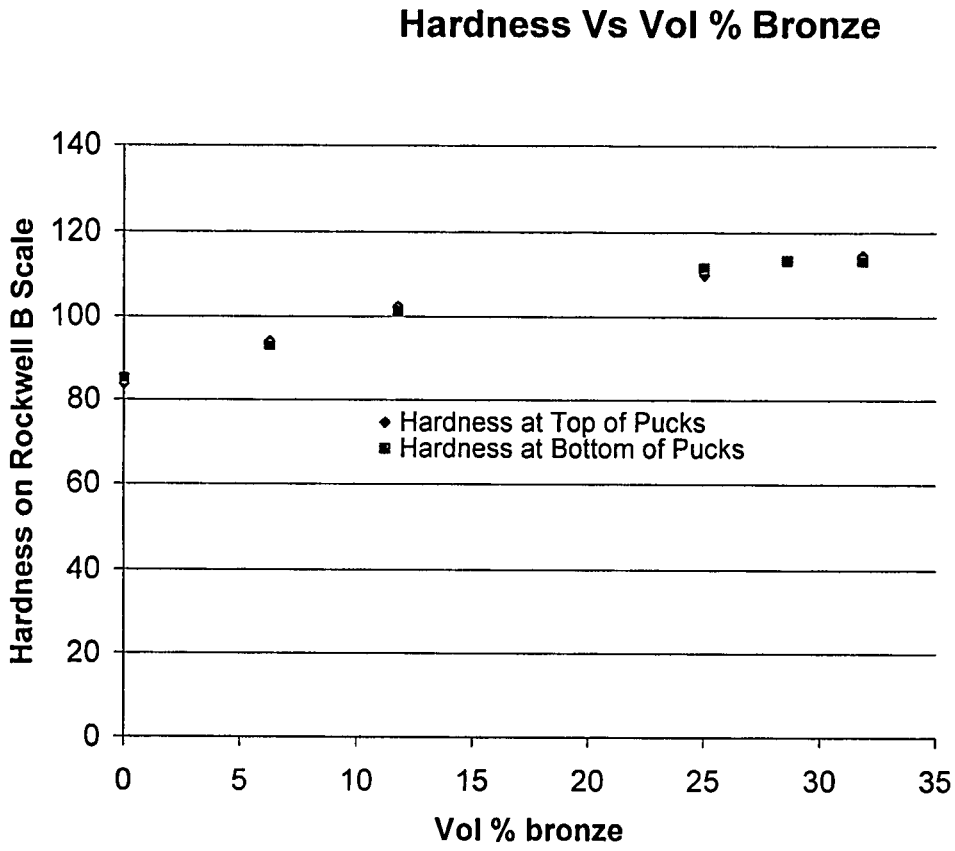

As previously discussed, the intrinsic porosity can be provided and controlled, for example, by the amount of bronze used in conjunction with the nickel and tin. In general, the greater the amount of bronze, the lower the volume of intrinsic pores and the more dense the resulting abrasive article. Likewise, the lower the amount of bronze, the greater the volume of intrinsic pores and the more intrinsically porous the resulting abrasive article. Various relationships between the amount of bronze in the metal bond and characteristics of that bond, including density, porosity, and hardness are shown in FIGS. 1*a-c*, respectively, in accordance with one embodiment of the present invention. In this particular example, the bronze is 50:50 by weight copper-tin alloy and the ratio of nickel to tin is 50:50 by weight, with the bronze being about 25% by volume and the volume of nickel and tin is about 75%.

The closed porosity can be provided and controlled, for example, through the use of persistent hollow pore inducers such as glass or ceramic or metal spheres, and/or sacrificial pore inducers such as calcium carbonate, crushed walnut shells, plastic or polymer beads, thermoplastic binders, and wax. Additional details regarding the use of persistent pore inducers to provide closed porosity are provided in the previously incorporated U.S. Pat. No. 5,203,886. Additional details regarding the use of sacrificial pore inducers to provide closed porosity are provided in the previously incorporated U.S. Pat. Nos. 5,221,294 and 5,429,648.

The interconnected porosity can be provided and controlled, for example, through the use of leachable dispersoids such as sodium chloride (melting point of about 800° C.), sodium aluminum silicate (melting point of about 1650° C.), magnesium sulfate (melting point of about 1124° C.), potassium phosphate (melting point 1340° C.), potassium silicate (melting point of about 976° C.), sodium metasilicate (melting point of about 1088° C.), or mixtures thereof. Additional details regarding the use of dispersoids to provide interconnected porosity are provided in the previously incorporated U.S. Pat. Nos. 6,685,755 and 6,755,729. In one particular embodiment, the interconnected porosity is formed by adding a dispersoid to the abrasive grains and metal bond prior to sintering the composite, and then immersing said sintered composite into a solvent to dissolve the dispersoid. For instance, the dispersoid can be sodium chloride, and the solvent can be water, and in particular, boiling water. Other embodiments may employ cold water as the solvent. In any such cases, the resulting abrasive article is substantially free of dispersoid particles.

Figure 2A:
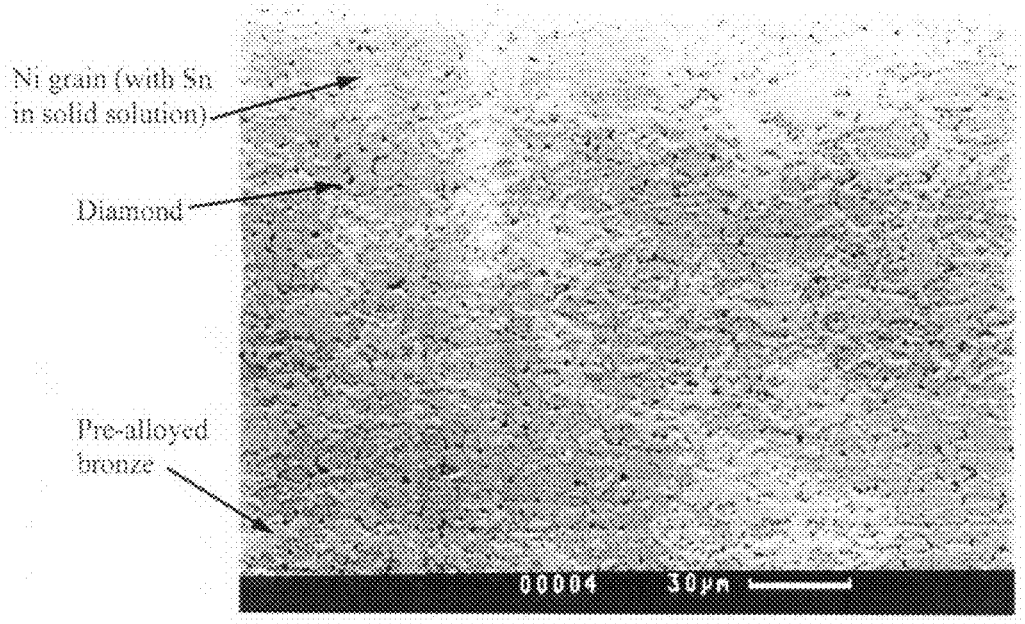
FIGS. 2*a* and 2*b* are SEM images of a hot-pressed nickel-tin-bronze bond system illustrating a dense structure with no or minimal porosity, in accordance with one embodiment of the present invention.
Figure 2B:
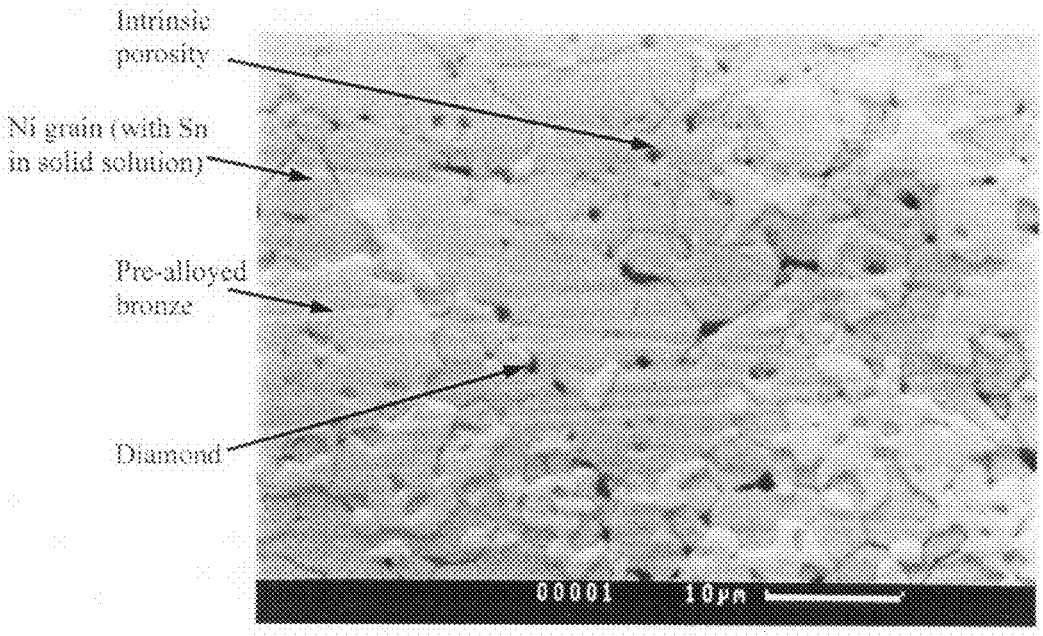
Figure 3A:
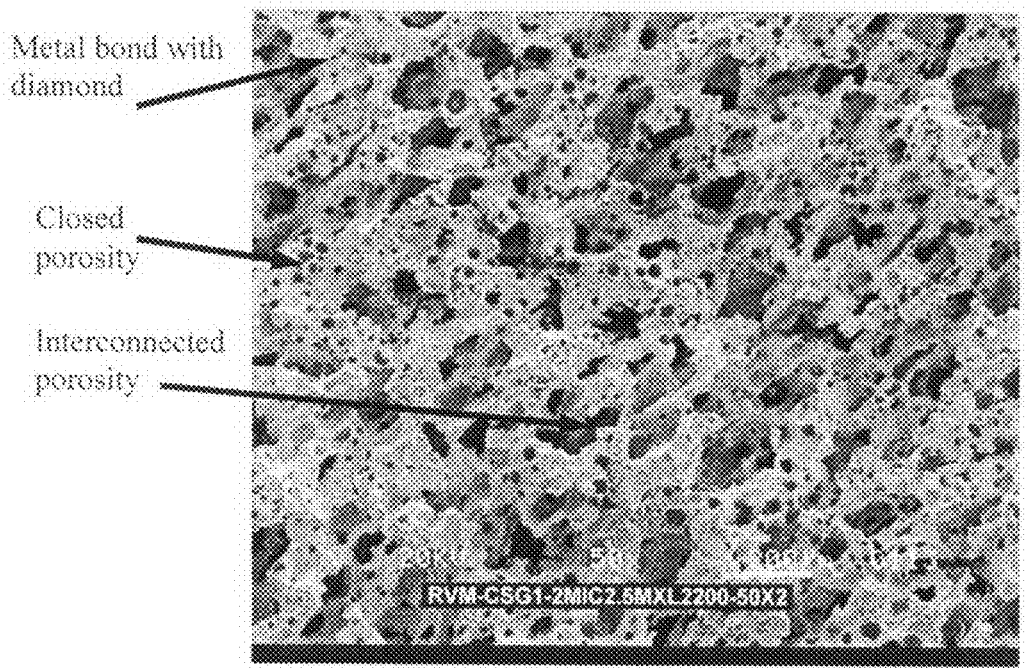
FIGS. 3*a* and 3*b* are SEM images of fractured surface of a nickel-tin-bronze bond system illustrating a porous structure with closed porosity resulting from glass spheres, as well interconnected porosity resulting from leached salt, in accordance with one embodiment of the present invention.
Figure 3B:
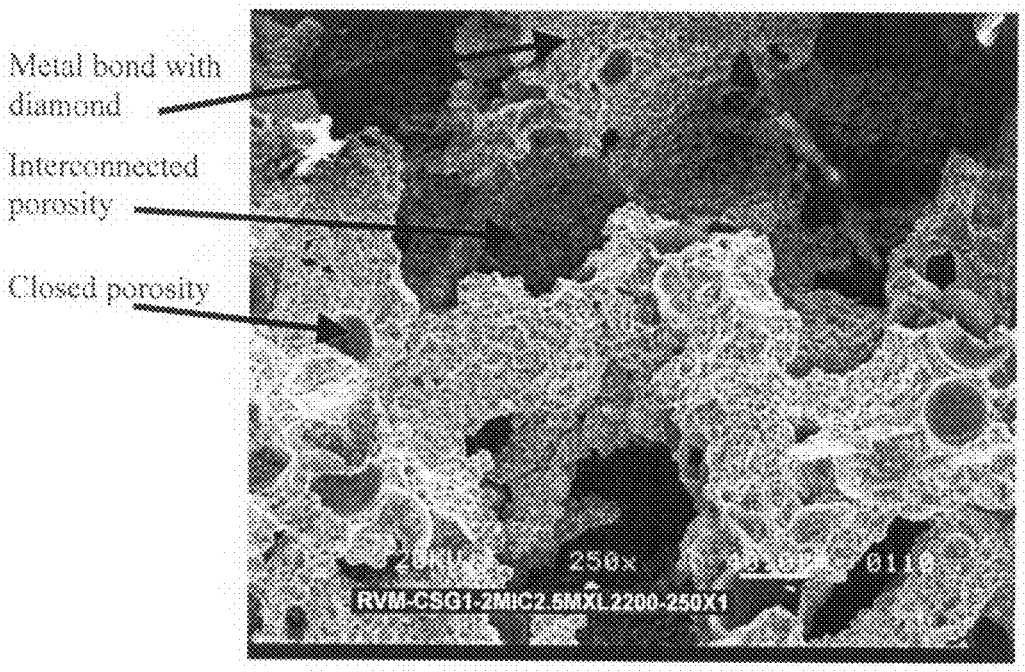
Figure 4A:
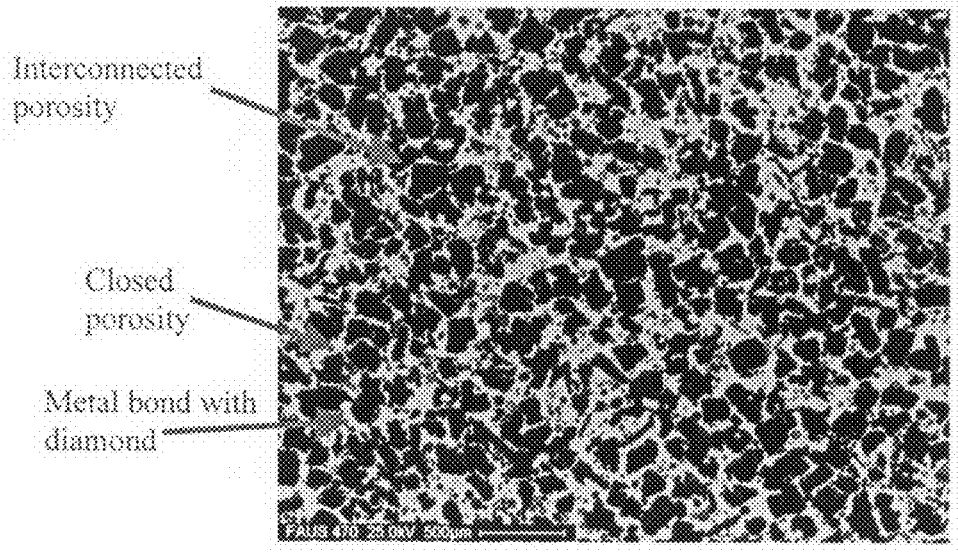
FIGS. 4*a* and 4*b* are SEM images of polished surface of a nickel-tin-bronze bond system illustrating a porous structure with closed porosity resulting from glass spheres, intrinsic porosity, as well as inter-connected porosity from leached salt, in accordance with one embodiment of the present invention.
Figure 4B:
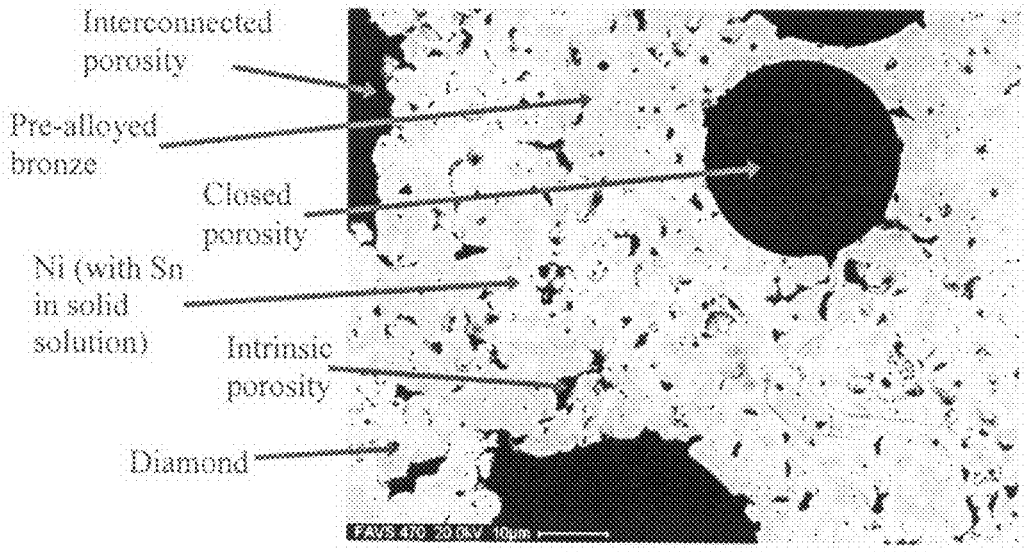

FIGS. 2*a* and 2*b* are SEM images of a nickel-tin-bronze bond system hot-pressed bond, with no induced porosity. As can be seen, fine diamond particles are distributed uniformly at the boundaries of the fine nickel grains. The bond looks densified and there is no evidence of porosity, other than a small amount of intrinsic porosity. FIGS. 3*a* and 3*b* are SEM images of the fractured surface of a nickel/tin/bronze/diamond wheel segment in which interconnected porosity is created by removal of salt via a post-firing leaching process, and closed porosity is created with glass spheres present within the metal bond, in accordance with one embodiment of the present invention. FIGS. 4*a* and 4*b* are SEM images of a nickel/tin/bronze/diamond wheel segment illustrating a porous structure with closed porosity resulting from glass spheres, intrinsic porosity resulting from components/composition selection for the bond system and process parameters (including the use of pre-alloyed bronze in this case), as well as inter-connected porosity from leached salt, in accordance with one embodiment of the present invention. As will be apparent in light of this disclosure, each of the porosity types (intrinsic, closed, and interconnected) can be used in any combination in a single abrasive product, in accordance with various embodiments of the present invention.

The components making up the metal bond according to one embodiment of the present invention are in powder form (or at least some subset of the metal bond components). In one such example case, the starting powder in metal bond has an average particle size that is at most 15 times larger than the average particle of the abrasive grains. In another such example case, the starting powder in metal bond has an average particle size that is at most 10 times larger than the average particle of the abrasive grains. In another such example case, the starting powder in metal bond has an average particle size that is at most 2 times larger than the average particle of the abrasive grains. In another such example case, the starting power in the metal bond has an average particle size that is equal to or smaller than the average particle of the abrasive grains (e.g., about 1:1 to 0.1:1 ratio, respectively).

The components of the metal bond may include, for example, any one or combination of metal and alloy powders such as one or more of nickel, cobalt, silver, iron, tin, zinc, tungsten, molybdenum, aluminum, copper, and titanium. The metal bond may further include small additions of boron, silicon and/or phosphorous, graphite, hexagonal boron-nitride, molybdenum disulfide, tungsten disulfide, and alumina. In one specific embodiment, the metal bond matrix includes from about 25 to 60 weight percent nickel, from about 20 to 60 weight percent tin, and from about 20 to 60 weight percent bronze alloy. The bronze includes, for example, a copper-tin ratio that can vary from about 95:5 to 40:60 by weight percent.

As previously explained, the composite can be processed in a number of ways, including sintering, hot-pressing, hot-coining, injection molding, or otherwise processed with suitable powder metallurgy processes. In one example embodiment, the interconnected porosity is induced through the use of a dispersoid (e.g., sodium chloride), and the composite is sinterable at a temperature below the melting point of the dispersoid. Alternatively, or in addition to, closed porosity is induced through the use of pore-forming additives that remain in the final article, such as a hollow filler (e.g., glass spheres), and the composite is sinterable at a temperature below the softening or melting point of those additives. Alternatively, or in addition to, closed porosity is induced through the use of pore-forming additives that burn out during processing of the article, such as crushed walnut shells, and the composite is sinterable at a temperature above the degradation temperature of those additives.

As previously explained, either monolithic or segmented grinding wheels can be fabricated in accordance with an embodiment of the present invention. In one particular case, a segmented grinding wheel is provided. The wheel includes a core and an abrasive rim including a plurality of the abrasive articles or segments. A thermally stable bond, such as an epoxy adhesive bond, a metallurgical bond, a mechanical bond, a diffusion bond, or other suitable bonding agent (or combinations thereof) is used between the core and each of the segments to secure the segments in place about the core. Each of the segments includes a composite as described herein. In one specific example, the composite includes a plurality of abrasive grains and a metal bond matrix sintered together, wherein the composite has a plurality of interconnected pores disposed therein, and contains from about 40 to 90 volume percent total porosity.

Although the specific structure and performance parameters will vary from one embodiment to the next, in one such example the core has a circular perimeter and a minimum specific strength of 2.4 MPa-$cm^3$/g and a core density of 0.5 to 8.0 g/$cm^3$. The metal bond with triple type porosity possesses plain-strain fracture toughness in the range of 1 to 6 MPa.$m^{1/2}$, a Vickers hardness number in the range of 80 to 800, a Young's modulus in the range of 30 to 300 GPa, and a density in the range of 2 grams/cc to 12 grams/cc. In addition, the composite possesses a wear volume in the range of 5 to 400 $mm^3$ when using a 5 Newton load on a wear test as will be described in detail in Example 7.

Example abrasive wheels configured in accordance with various embodiments of the present invention were prepared in the form of Type 2A2TS metal bonded wheels utilizing materials and processes as will now be described. Numerous other embodiments will be apparent in light of this disclosure, and the present invention is not intended to be limited to any particular one.

EXAMPLE 1

A powder metal alloy consisting of nickel, tin and bronze was mixed with fine diamond, salt, and hollow glass spheres. In more detail, 60.93 grams of nickel powder (obtained from AcuPowder International LLC, Union, N.J. as 123 Nickel) was blended with 60.93 grams of tin (also obtained from Acupowder International LLC, Union, N.J. as 115 Tin) and 1.56 grams of diamond (obtained from Diamond Innovations, Worthington, Ohio as RVM-CSG 1-2 microns) in a Turbula® mixer. Then, 52.22 grams of Bronze powder (obtained from United States Bronze Powders, Maryville, Tenn. as M3590 powder) screened to −635 U.S. mesh was added to the mix along with 2.62 grams of hollow glass spheres (obtained from E.V. Roberts Inc, Carson, Calif.) and 91.95 grams of salt (obtained as Diamond Crystal non-iodized salt from Shaw's Supermarkets, Inc, Worcester, Mass. and sized to −70/+80 U.S. mesh), and Turbula® mixed again to provide a homogenous blend. The resulting mixture included 29.8% of metal bond, 59.6% of salt, and 9.9% of glass spheres by volume. The resulting mixture was then placed in a graphite disk mold, leveled and hot pressed at 750° C. for 10 minutes at 22 MPa (3200 psi). Upon cooling, the resulting abrasive disk was immersed in cold water to leach out the salt present, leaving an interconnected, porous structure. The nature of processing and the component mix left intrinsic porosity in the structure, and hollow glass spheres provided closed porosity as well.

The disk was then cut up into segments of desired shape, dimensions and tolerances to match the periphery of a machined aluminum core. The segments have an arcuate profile having an outer radius of curvature of 127 millimeters (5 inches) and an inner radius of curvature of 124 millimeters (4.9 inches). The segments were used to construct a Type 2A2TS face-grinding type grinding wheel. The grinding wheel of this particular embodiment uses sixteen symmetrically spaced segments bonded to the aluminum core, yielding a grinding wheel having an outer diameter of about 282 millimeters (11.1 inches) and a slotted rim. The segments protrude out of the aluminum core a distance of about 5 millimeters (0.196 inches). The abrasive segment and the aluminum core were assembled with an epoxy resin/hardener cement system (Epotek NDT 353 adhesive obtained from Epotek, Mass.). The segments were then machined to be at the same height from the aluminum core. The wheel was then balanced and speed tested for use.

A metal bonded segmental wheel fabricated according to Example 1 ("Example 1 wheel") was tested for finish back-grinding performance of single crystal silicon carbide wafers. A standard wheel made from a commercially available system, with a grit size of 1-2 microns and 2.5 concentration in a copper/tin/phosphorous bond (wheel specification Polish# 1-24-XL073, obtained from Saint Gobain Abrasives, Inc, Worcester, Mass.) was also tried in place of the Example 1 wheel for comparison purposes, on the same work material, using the same grinding conditions. In addition, note that a commercially available grinding wheel (wheel specification FINE#4-17-XL073, obtained from Saint Gobain Abrasives, Inc) was used for coarse grinding to remove coarse and relatively large defects on the SiC wafer surface. The grinding machine used has two spindles to accommodate a coarse grinding wheel followed by a fine wheel. The grinding test conditions, including grinding machine type, wheel specifications and size, and grinding mode, are shown in Table 1.

TABLE 1

| Grinding Test Conditions | |
|---|---|
| Grinding Machine | Strasbaugh 7 AF Model |
| Wheel Specifications | Coarse wheel: FINE#4-17-XL073<br>Fine wheel: Wheel in Example 1 |
| Wheel Size | Type 2A2TSSA: 282 × 29 × 229 mm<br>(11.1 × 11/8 × 9 inch) |
| Grinding Mode | Dual Grinding: Coarse grind followed by fine grind |

The truing and dressing operation conditions for the coarse wheel are shown in Table 2. As is known, truing and dressing operations refer to wheel preparation before its use, and in this particular case, before its use under the grinding test conditions specified in Table 1. The conditions include dressing pad type, wheel speed, work speed, material removed, feed rate, and dwell.

TABLE 2

| Truing and Dressing Operation, Coarse Wheel | |
|---|---|
| Dressing Pad | Coarse pad |
| Wheel Speed | 1200 rpm |
| Work Speed | 50 rpm |
| Material removed | 200 microns |
| Feed Rate | 2 micron/second for 1st 190 microns, 0.2 microns/seconds for next 10 microns |
| Dwell | 25 revolutions |

The truing and dressing operation conditions for the fine wheel are shown in Table 3. Just as with the coarse wheel, the conditions include dressing pad type, wheel speed, work speed, material removed, feed rate, and dwell.

TABLE 3

| Truing and Dressing Operation, Fine Wheel | |
|---|---|
| Dressing Pad | Extra-Fine pad |
| Wheel Speed | 1200 rpm |
| Work Speed | 50 rpm |
| Material removed | 300 microns |
| Feed Rate | 1 micron/second for 1st 290 microns, 0.2 microns/seconds for next 10 microns |
| Dwell | 25 revolutions |

Particulars of the coarse grinding process, including wheel speed, coolant type and flow rate, material removed, feed rate, work speed, and dwell, are specified in Table 4. As can be seen, the work materials were 76.2 mm diameter (3 inches) single crystal silicon carbide (SiC) wafers, with each wafer having a starting thickness of 434 microns (0.017 inches).

TABLE 4

| Coarse Grinding Process | |
|---|---|
| Wheel Speed | 1100 rpm |
| Coolant | De-ionized water |
| Coolant Flow Rate | 3 gal/min (11 liters/min) |
| Work Material | Silicon carbide wafers, single crystal, 76.2 mm diameter (3 inch), 434 micron (.017 inch) starting thickness (obtained from CREE Research, Inc) |
| Material removed | 84 microns |
| Feed Rate | 0.7 microns/second |
| Work Speed | 590 rpm |
| Dwell | 0 |

The fine grinding process, specified in Table 5, is performed after the coarse grinding process. As can be seen, the wheel speed is faster and the feed rate is slower. The material removed during the fine grind is less, relative to the coarse grind, and the dwell is 5 revolutions. The starting thickness of the fine grind is 350 microns (0.0138 inches).

TABLE 5

| Fine Grinding Process | |
|---|---|
| Wheel Speed | 3000 rpm |
| Coolant | De-ionized water |
| Coolant Flow Rate | 3 gal/min (11 liters/min) |

TABLE 5-continued

| Fine Grinding Process | |
|---|---|
| Work Material | Silicon carbide wafers, single crystal, 76.2 mm diameter (3 inch), 350 micron (0.0138 inch) starting thickness (obtained from CREE Research, Inc) |
| Material removed | 20 microns |
| Feed Rate | Ranging from 0.4 to 0.05 microns per second |
| Work Speed | 590 rpm |
| Dwell | 5 revolutions |

The standard wheel and the Example 1 wheel configured in accordance with an embodiment of the present invention had the same level of overall porosity, grit size, grit type, and concentration of abrasive. The standard wheel was unable to grind and did not remove any stock. When the same bond was used with a 2 to 4 micron diamond, the standard wheel was able to grind the single crystal SiC wafer surface with a material removal rate of 0.05 microns per second, grinding forces 25 lbs, to a surface finish between 40-50 Angstroms, Ra. Such results indicate that simply reducing the abrasive grit size alone without tailoring the bond does not produce fine surface finishes and stock removal on silicon carbide surface.

Results for the grinding test specified in Table 1 are shown in Table 6. Twelve wafers were fine ground using the Example 1 wheel. As can be seen, the Example 1 wheel exhibited relatively stable peak normal forces. Each wheel also required approximately the same peak normal force. This type of grinding performance is highly desirable, for example, in back-grinding SiC wafers because these relatively low force steady state conditions minimize thermal and mechanical damage to the work piece.

TABLE 6

| Grinding Test Results | | | |
|---|---|---|---|
| Wafer No. | Side No. | Forces, Newtons | Forces, lbs. |
| 33 | 1 | 84.52 | 19 |
| 33 | 2 | 84.52 | 19 |
| 34 | 1 | 97.86 | 22 |
| 34 | 2 | 93.41 | 21 |
| 34-reground | 1 | 88.96 | 20 |
| 34-reground | 2 | 88.96 | 20 |
| 35 | 1 | 93.41 | 21 |
| 35 | 2 | 84.52 | 19 |
| 35-reground | 1 | 88.96 | 20 |
| 35-reground | 2 | 93.41 | 21 |
| 38 | 1 | 88.96 | 20 |
| 38 | 2 | 93.41 | 21 |

Figure 5:
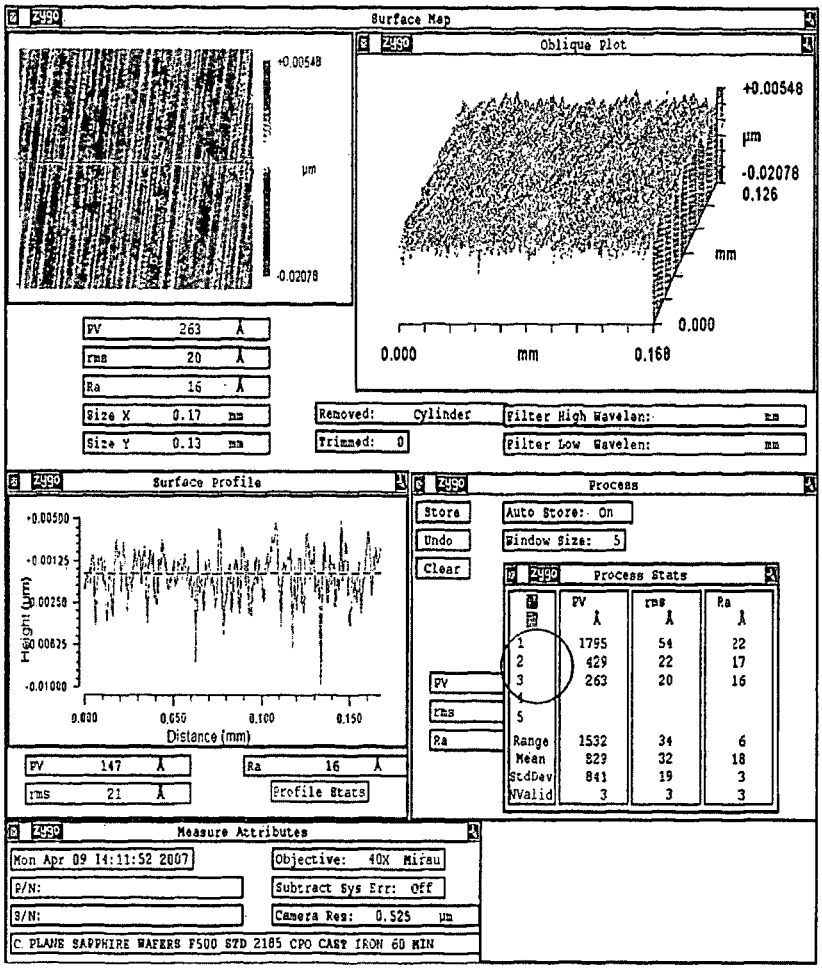
FIG. 5 demonstrates that grinding with a wheel configured in accordance with an embodiment of the present invention significantly reduces surface roughness ($R_a$) of the workpiece.

Furthermore, the Example 1 wheel configured in accordance with an embodiment of the present invention provided for the highly desirable grinding performance described in Table 6, for at least fifteen wafers without the need for dressing of the wheel. In addition, the Example 1 wheel significantly reduced the surface roughness, as shown in FIG. 5 (measured by a Zygo® White-light interferometer, Zygo Corporation, Middlefield, Conn.). Grinding with the Example 1 wheel consistently reduced the average surface roughness ($R_a$) from a starting value of greater than 100 Angstroms down to 15-30 Angstroms, $R_a$. Note that circled portion on lower right side of FIG. 5 shows actual surface finishes achieved included 16, 17, and 22 Angstroms, $R_a$. In summary, the Example 1 wheel provides desirable grinding performance on hard, brittle silicon carbide wafers. Surface finish $R_a$ values of 30 Angstroms and less are enabled, which are relatively superior to surface finishes achievable with conventional tools (40 Angstroms, Ra and greater).

The same Example 1 wheel was also tested for finish back-grinding performance of single crystal silicon-carbide wafers on another machine having higher stiffness than the Strasbaugh machine. Just as with the previous test, a commercially available grinding wheel (wheel specification FINE#4-17-XL073, obtained from Saint Gobain Abrasives, Inc) was used for coarse grinding to remove coarse and relatively large defects on the SiC wafer surface. The machine employed for this particular grinding test has one spindle which was used to mount both the coarse and fine wheels. The grinding testing conditions are shown in Table 7.

TABLE 7

| Grinding Test Conditions | |
|---|---|
| Machine | DCM machine |
| Wheel Specifications | Coarse wheel: FINE#4-17-XL073<br>Fine wheel: Example 1 Wheel |
| Wheel Size | Type 2A2TSSA: 282 × 29 × 229 mm<br>(11.1 × 11/8 × 9 inch) |
| Grinding Mode | Dual Grinding: Coarse grind followed by fine grind |

Particulars of the coarse grinding process on the DCM machine, including wheel speed, coolant type and flow rate, material removed, feed rate, work speed, and dwell, are specified in Table 8. Just as with the previous grinding test on the Strasbaugh machine, the work materials were 76.2 mm diameter (3 inches) single crystal silicon carbide (SiC) wafers, with each wafer having a starting thickness of 434 microns (0.017 inches).

TABLE 8

| Coarse Grinding Process | |
|---|---|
| Wheel Speed | 1800 rpm |
| Coolant | Water with 5 vol % rust inhibitor |
| Coolant Flow Rate | 3 gal/min (11 liters/min) |
| Work Material | Silicon carbide wafers, single crystal,<br>76.2 mm diameter (3 inch),<br>434 micron (.017 in.) starting thickness<br>(obtained from CREE Research, Inc) |
| Material removed | 50 microns |
| Feed Rate | 0.24 microns/second |
| Work Speed | 30 rpm |
| Dwell | 0 |

The fine grinding process on the DCM machine, specified in Table 9, is performed subsequent to the coarse grinding process. The wheel speed is faster and the feed rate is slower. In this case, note that the material removed during the fine grind is greater relative to the coarse grind. The starting thickness of the fine grind is 350 microns (0.0138 inches).

TABLE 9

| Fine Grinding Process | |
|---|---|
| Wheel Speed | 2500 rpm |
| Coolant | Water with 5 vol % rust inhibitor |
| Coolant Flow Rate | 3 gal/min (11 liters/min) |
| Work Material | Silicon carbide wafers, single crystal,<br>76.2 mm diameter (3 inch),<br>350 micron (0.0138 inch) starting thickness<br>(obtained from CREE Research, Inc.) |
| Material removed | 140 microns |
| Feed Rate | 0.12 microns per second |

TABLE 9-continued

| Fine Grinding Process | |
|---|---|
| Work Speed | 31 rpm |
| Dwell | 0 |

The Example 1 wheel exhibited relatively low spindle power of 24% of maximum load. The grinding results of the Example 1 wheel on the DCM machine were similar to that of the Example 1 wheel results on the Strasbaugh machine. However, since a higher stiffness DCM machine was used, the wheel wear was higher (about 200 microns in removing 140 microns of wafer). A surface finish of 78-159 Angstroms, Ra was achieved. The actual depth of cut as opposed to the set depth of cut on a high stiffness machine is larger than that obtained on a low stiffness machine such as Strasbaugh 7AF. In addition, the re-circulation of coolant at high vibrations on the DCM can also affect the surface finish. Thus, properties of the grinding machine, such as its spindle stiffness, may also be considered in achieving desired performance such as target stock removal and surface finish.

EXAMPLE 2

Example 2 refers to an example grinding wheel in accordance with another embodiment of the present invention. In particular, the wheel of Example 2 is similar to the wheel described in Example 1, except there are no glass spheres added in the bond. About 71% salt was introduced in the wheel, which was leached out prior to use. The amounts of various components required to produce the wheel of Example 2 include 58.89 grams of nickel, 58.89 grams of tin, 50.48 grams of bronze, 108.81 grams of salt, and 1.56 grams of diamond.

A metal bonded segmental wheel fabricated according to Example 2 using the methodology described in Example 1 ("Example 2 wheel") was tested for finish back-grinding performance of silicon carbide wafers. An initial coarse grind was carried out as previously described with reference to the Example 1 wheel, to remove coarse and relatively large defects on the SiC wafer surface. The grinding conditions were as previously described with reference to Tables 1 through 5. The grinding results of the Example 2 wheel are similar to that of the Example 1 wheel (Table 6). However, the higher level of salt in accordance with the Example 2 wheel resulted in lower yield issues in manufacturing. In more detail, recall that the Example 1 wheel had about 60% by volume of salt (which was leached out before use) and about 10% by volume of hollow glass spheres for a total of 70% porosity. On the other hand, the Example 2 wheel had about 71% salt that was leached out and no glass spheres. Both wheels are considered to have nearly the same amount of porosity. Their grinding performances (e.g., example wheel wear for given amount of stock removed, normal grinding forces, and surface finish on silicon carbide) were nearly identical, within error limits. However, the Example 2 wheel containing 71% by salt was relatively more difficult to manufacture and resulted in occasional chipped wheel segments that had to be replaced. Thus, such a product as that of the Example 2 wheel is technically feasible, but may not be suitable for all applications due to such yield issues.

EXAMPLE 3

Example 3 refers to an example grinding wheel in accordance with another embodiment of the present invention. In particular, the wheel of Example 3 is similar to the wheel described in Example 1, except that a different type of salt was used. The salt used was single crystal and cubic (obtained as Purex Fine Prepared Salt from Morton Salt Co. Inc, Chicago, Ill. and sized to −70/+80 U.S. mesh) in contrast to the polycrystalline and irregular shaped salt used in Example 1 (obtained as Diamond Crystal non-iodized salt from Shaw's Supermarkets, Inc, Worcester, Mass. and sized to −70/+80 U.S. mesh). The amounts of various components required to produce the wheel of Example 3 included 60.93 grams of nickel, 60.93 grams of tin, 52.22 grams of bronze, 91.95 grams of salt, 2.62 grams of glass-spheres, and 1.56 grams of diamond.

A metal bonded segmental wheel fabricated according to Example 3 using the methodology described in Example 1 ("Example 3 wheel") was tested for finish back-grinding performance of silicon carbide wafers. An initial coarse grind was carried out as previously described with reference to the Example 1 wheel, to remove coarse and relatively large defects on the SiC wafer surface. The grinding conditions were as previously described with reference to Tables 1 through 5. The grinding results of the Example 3 wheel are similar to that of the Example 1 wheel (Table 6). However, use of cubic salt in accordance with Example 3 resulted in about two times lower wheel wear than that of the Example 1 wheel.

EXAMPLE 4

Example 4 refers to an example grinding wheel in accordance with another embodiment of the present invention. In particular, the wheel of Example 4 is similar to the wheel described in Example 1, except that a higher volume of porosity was introduced in the wheel. The wheel possessed about 75 vol % pore inducers (salt+glass spheres) in contrast to 70 vol % pore inducers (salt+glass spheres) created in the Example 1 wheel. The amounts of various components required to produce the wheel of Example 4 included 50.79 grams of nickel, 50.79 grams of tin, 43.53 grams of bronze, 91.94 grams of salt, 3.93 grams of glass-spheres, and 1.56 grams of diamond.

Figure 6:
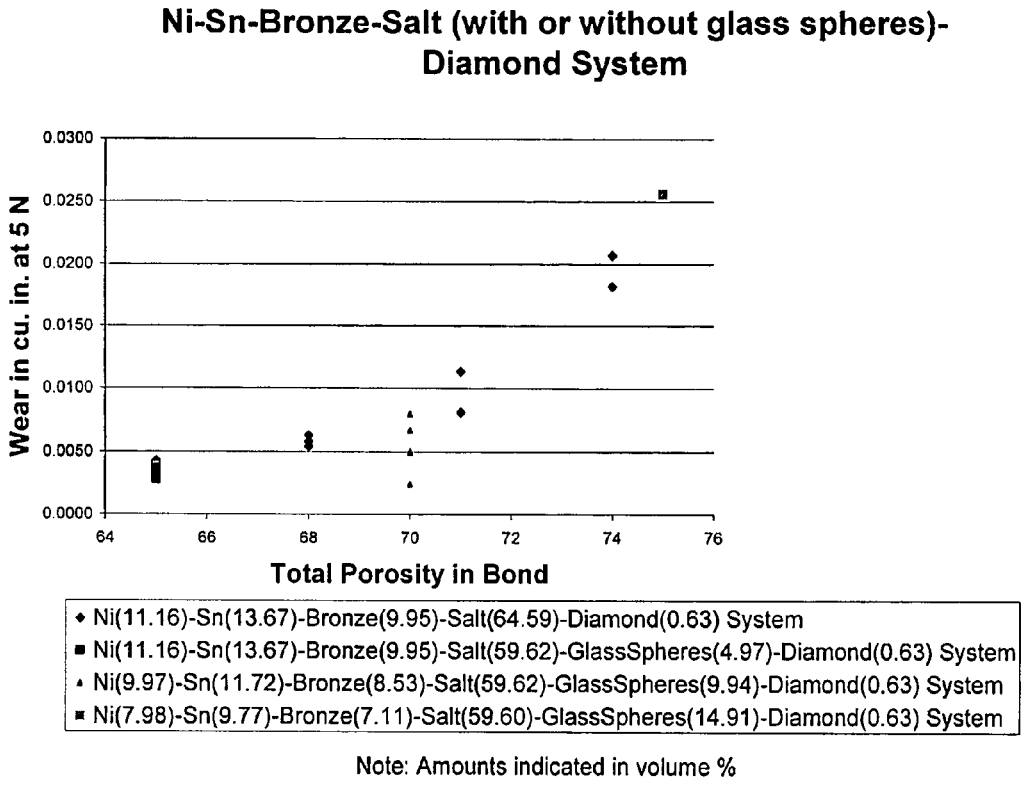
FIG. 6 illustrates a relationship between total porosity in a nickel-tin-bronze bond and wear resistance of that bond, in accordance with one embodiment of the present invention.

A metal bonded segmental wheel fabricated according to Example 4 using the methodology described in Example 1 ("Example 4 wheel") was tested for finish back-grinding performance of silicon carbide wafers. An initial coarse grind was carried out as previously described with reference to the Example 1 wheel, to remove coarse and relatively large defects on the SiC wafer surface. The grinding conditions were as previously described with reference to Tables 1 through 5, except that the diameter of the SiC work material was 100 mm (4 inches) instead of 75 mm (3 inches). A high porosity wheel was chosen for this work material so as to reduce the contact area between the wheel and the work piece. This not only helps in reducing forces, but also expedites the release of diamond which would dull faster on a larger work piece. The grinding results of the Example 4 wheel are similar to that of the Example 1 wheel (Table 6). However, the wheel wear of the wheel in accordance with Example 4 was twice as much as that of the Example 1 wheel. This can be attributed to the fact that the Example 4 wheel possessed a higher level of porosity, and it was used to grind a larger wafer. The forces in grinding were at 11 lbs. FIG. 6 illustrates a relationship between total porosity in a nickel-tin-bronze bond and wear resistance of that bond, in accordance with an embodiment of the present invention. As can be seen, wheel wear increases as the volume percent of total porosity increases. This is the case whether the total porosity includes porosity induced by salt alone, or by both salt and glass spheres.

EXAMPLE 5

Example 5 refers to an example grinding wheel in accordance with another embodiment of the present invention. In particular, the wheel of Example 5 is similar to the wheel described in Example 1, except that a different type of nickel powder was used. The nickel powder used in the wheel of Example 5 was much finer in size (obtained as Extra Fine Nickel Powder Type 110 from Novamet Specialty Products, Wyckoff, N.J.) relative to the nickel powder used in Example 1 wheel. The nickel powder particle size is in the 1-2 micron range, which is significantly finer than the 123 nickel powder (3.5 to 4.5 microns) used in the Example 1 wheel. The amounts of various components required to produce the wheel of Example 5 included 60.93 grams of nickel, 60.93 grams of tin, 52.22 grams of bronze, 91.95 grams of salt, 2.62 grams of glass-spheres, and 1.56 grams of diamond.

A metal bonded segmental wheel fabricated according to Example 5 using the methodology described in Example 1 ("Example 5 wheel") was tested for finish back-grinding performance of silicon carbide wafers. An initial coarse grind was carried out as previously described with reference to the Example 1 wheel, to remove coarse and relatively large defects on the SiC wafer surface. The grinding conditions were as previously described with reference to Tables 1 through 5. The grinding results of the Example 5 wheel are similar to that of the Example 1 wheel (Table 6). However, since a finer nickel powder was used in the Example 5 wheel, the wheel life was about 50% more than that of the Example 1 wheel (e.g., due to better sintering and diamond distribution obtained with fine Ni powder).

EXAMPLE 6

Example 6 refers to an example grinding wheel in accordance with another embodiment of the present invention. In particular, the wheel of Example 6 is similar to the wheel described in Example 1, except that different sizes of diamond and salt were used. A relatively coarser diamond was used (obtained as RVM-CSG 6-12 microns, from Diamond Innovations, Worthington, Ohio). The salt was sized to −80/+100 US mesh in contrast to the −70/+80 U.S. mesh size salt used in the Example 1 wheel. The Example 6 wheel possessed about 75 vol % pore inducers (salt+glass spheres) in contrast to 70 vol % pore inducers (salt+glass spheres) created in the Example 1 wheel. Additionally, higher diamond concentration (5 concentration) was used. The amounts of various components required to produce the Example 6 wheel included 50.47 grams of nickel, 50.47 grams of tin, 43.26 grams of bronze, 91.36 grams of salt, 3.90 grams of glass-spheres, and 3.13 grams of diamond.

A metal bonded segmental wheel fabricated according to Example 6 using the methodology described in Example 1 ("Example 6 wheel") was tested for finish back-grinding performance of silicon carbide wafers. An initial coarse grind was carried out as previously described with reference to the Example 1 wheel, to remove coarse and relatively large defects on the SiC wafer surface. The grinding conditions were as previously described with reference to Tables 1 through 5. The grinding results of the Example 6 wheel are similar to that of the Example 1 wheel (Table 6). However, since a finer salt was used in the Example 7 wheel, the wheel life decreased slightly (about 5% to 15% drop). Note, however, that the higher diamond concentration tends to extend wheel life. Thus, should a finer salt or other dispersoid be desirable, a higher abrasive concentration can be used in conjunction with that finer dispersoid to keep wheel life relatively stable.

EXAMPLE 7

Example 7 refers to an example grinding wheel in accordance with another embodiment of the present invention. In particular, the wheel of Example 7 ("Example 7 wheel") was made from a composition including nickel, tin, and bronze in the weight ratio of 35/35/30, and compared to wheel made from a composition including elemental nickel, tin and copper in the weight ratio of 35/50/15. The bronze used in the Example 7 wheel was a 50/50 by weight ratio of copper and tin, so both the Example 7 wheel composition and the comparative wheel's elemental composition had the same levels of nickel, tin and copper. The amounts of various components required to produce the Example 7 wheel included 69.70 grams of nickel, 99.57 grams of tin, 29.87 grams of copper, 91.94 grams of salt, 1.31 grams of glass-spheres, and 1.56 grams of diamond.

In order to determine the relative durability of the different bond compositions, a wear test was used. In more detail, the wear test essentially includes taking a bond sample of known cross-sectional area and abrading it against a silicon carbide grit-laden surface at known loads and given lengths of time. The volume loss of the bond composition is measured and used to rank the different samples. Depending on the size and quantity, the bonds may also include diamond grits which makes the wear test simulate grinding more closely.

In the case of the Example 7 wheel, the wear test included manufacturing bond compositions of size 6.25×6.25×6.25 mm (0.25×0.25×0.25 inches) and attaching it to a sample holder that is 37.5 mm (1.25 inches) in diameter and 40 mm (1.6 inches) long using two-component epoxy and curing it. The cured bond-holder composite was inserted in to a sample carrier and secured with screws. The sample carrier was then mounted onto a polishing machine, such as Struers Roto-Force4. A coated abrasive sheet such as Buehler Carbimet Special Silicon Carbide, pre-cut to 254 mm (10 inch) in diameter was placed on the rotating work table and held in place. While the sample carrier was spun in the clockwise direction, the work table was spun in the counter-clockwise direction at 150 rpm. The sample and bond composite was brought into contact with the coated abrasive sheet at a known pre-set load for 5 seconds. The wear of the bond sample was measured and used to determine the relative durability. Since elemental powders sinter better than pre-alloyed material due to the presence of a thin oxide layer on the surface of the latter, the sample containing 35/35/30 of nickel, tin and bronze in accordance with the Example 7 wheel wore four times more than the sample made from elemental powders, under the conditions at which they were made.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An abrasive tool comprising:

a plurality of abrasive grains having an average particle size of 2 microns or less;

a metal bond including a nickel, tin and bronze system: and porosity including intrinsic pores, closed pores and interconnected pores;

wherein the abrasive tool comprises a content of abrasive grains in the range of 0.25 to 40 vol% for the total content of the abrasive tool, a content of metal bond in the range of 10 to 60 vol% for the total volume of the abrasive tool, and a content of porosity in the range of 40 to 90 vol% for the total volume of the abrasive tool; and wherein the content of porosity comprises a content of intrinsic pores in the range of 0.01 to 20 vol% for the total volume of the porosity, a content of closed pores in the range of 0.01 to 49.99vol% for the total volume of the porosity and a content of interconnected pores in the range of 50 to 80 vol% for the total volume of the porosity.

2. The abrasive tool of claim 1, wherein the abrasive grains include at least one of diamond, cubic boron nitride, alumina, silicon-carbide, boron-carbide, and zirconia.

3. The abrasive tool of claim 1, wherein the metal bond possesses a plain-strain fracture toughness in the range of 1 to 6 MPa.m$^{1/2}$, a Vickers hardness number in the range of 200 to 600, a Young's modulus in the range of 30 to 300GPa, and a density in the range of 2 grams/cc to 7 grams/cc.

4. The abrasive tool of claim 1, wherein the metal bond possesses a wear volume in the range of 5 to 400 mm$^3$ when using a 5 Newton load.

5. The abrasive tool of claim 1, wherein the interconnected pores have an average size in the range of 40 to 400 microns, the closed pores have an average size in the range of 5 to 400 microns, and the intrinsic pores have an average size below 40 microns.

6. The abrasive tool of claim 1, wherein the metal bond includes from about 25 to 60 weight percent nickel, from about 20 to 60 weight percent tin, and from about 20 to 60 weight percent bronze, wherein the bronze has a copper-tin ratio from about 95:5 to 40:60 by weight percent.

7. The abrasive tool of claim 1, wherein the abrasive tool further comprises an abrasive rim that is operatively coupled to a core via a thermally stable bond.

8. The abrasive tool of claim 7, wherein the core has a circular perimeter and a minimum specific strength of 2.4 MPa-cm$^3$/g and a core density of 0.5 to 8.0 g/cm$^3$.

9. The abrasive tool of claim 1, wherein the workpiece is a semiconductor wafer.

10. A method for abrasive processing a workpiece to a desired surface finish, the method comprising:

mounting the workpiece onto a machine capable of facilitating abrasive processing;

operatively coupling an abrasive tool to the machine, the tool comprising a metal bond thermally processed together with a plurality of abrasive grains having an average particle size of 2 microns or less, the metal bond including a nickel, tin and bronze system; and porosity including intrinsic pores, closed pores and interconnected pores;

wherein the abrasive tool comprises a content of abrasive grains in the range of 0.25 to 40 vol% for the total content of the abrasive tool, a content of metal bond in the range of 10 to 60 vol% for the total volume of the abrasive tool, and a content of porosity in the range of 40 to 90 vol% for the total volume of the abrasive tool; and wherein the content of porosity comprises a content of intrinsic pores in the range of 0.01 to 20 vol% for the total volume of the porosity, a content of closed pores in the range of 0.01 to 49.99 vol% for the total volume of the porosity and a content of interconnected pores in the range of 50 to 80 vol% for the total volume of the porosity; and contacting the abrasive tool to a surface of the workpiece until the desired surface finish of the workpiece is achieved, wherein the desired surface finish is 500 Angstroms or less, Ra.

11. The method of claim 10, wherein the workpiece comprises a wafer and abrasive processing includes at least one of polishing and back-grinding the wafer.

12. The method of claim 10, wherein the abrasive grains are selected from the group consisting of diamond, cubic boron nitride, alumina, silicon-carbide, boron-carbide, and zirconia.

13. The method of claim 10, wherein the workpiece is a single crystal silicon carbide wafer and the desired surface finish is 30 Angsroms or less, Ra.

14. The method of claim 10, wherein the workpiece is a single crystal silicon carbide wafer and the desired surface finish is 30 Angstroms or less, Ra.

15. The method of claim 10, wherein the workpiece is sapphire and the desired surface finish is 200 Angstroms or less, Ra.

16. The method of claim 10, wherein the metal bond includes from about 25 to 60 weight percent nickel, from about 20 to 60 weight percent tin, and from about 20 to 60 weight percent bronze, wherein the bronze has a copper-tin ratio from about 95:5 to 40:60 by weight percent.

* * * * *